US005592744A

United States Patent [19]

Weinstein

[11] Patent Number: 5,592,744

[45] Date of Patent: Jan. 14, 1997

[54] EATING UTENSIL

[76] Inventor: Alex H. Weinstein, 4403 W. Grace St., Richmond, Va. 23230

[21] Appl. No.: 563,956

[22] Filed: Nov. 29, 1995

[51] Int. Cl.[6] ..... A47J 43/28

[52] U.S. Cl. ..... 30/324

[58] Field of Search ..... 30/322, 323, 324, 30/325, 326, 327, 328, 340; D7/642, 653, 664

[56] References Cited

U.S. PATENT DOCUMENTS

| | | | |
|---|---|---|---|
| 296,051 | 4/1884 | Peters | 30/324 |
| 843,372 | 2/1907 | Smith | 30/324 |
| 1,288,617 | 12/1918 | Kupiszwski | 30/324 |
| 2,650,425 | 9/1953 | Brandel | 30/325 |

*Primary Examiner*—Douglas D. Watts

[57] ABSTRACT

A self-leveling spoon enables disabled persons and infants to feed themselves. The spoon is self-leveling due to a counter weight linked to the spoon of the bowl through the handle. The spoon provides enhanced stability because the bowl for holding food is free to move with two degrees of rotational freedom with respect to the handle of the spoon. This results in a spoon which is very forgiving of the decreased motor skills of individuals who have been injured, or are suffering the effects of certain diseases, or are merely young children struggling to master cutlery. The spoon may be partially disassembled for easy cleaning.

16 Claims, 9 Drawing Sheets

EATING UTENSIL

BACKGROUND OF THE INVENTION

1. Field of the Invention

This invention relates to the field of cutlery. More specifically, this invention relates to the art of helping persons having undeveloped, reduced, or impaired motor skills to feed themselves.

2. Background Art

Many people find it difficult to feed themselves with conventional cutlery due to their physical status. Young children may find it frustrating to try to emulate their parents' use of forks and spoons at the dinner table. More often, the parents of those children have found it taxing to endure the constant spillage of food while indoctrinating the youngsters in the proper use of the forks and spoons. Before the age of eighteen months, many children are still struggling to develop the physical coordination necessary to master adult-style eating habits.

Adults may also have trouble using common cutlery. Some diseases, such as cerebral palsy (CP) and Parkinson's, and injuries to the spinal column can result in partial impairment of motor skills which make feeding one's self difficult, if not impossible. Parkinson's and CP cause uncontrollable tremors in the arms which make it difficult to hold liquid on a spoon or to aim a fork at a given piece of food. Spinal column injuries (or other kinds of nerve damage for that matter) can result in an ability to only partially control the movement of the arms; the possible range of motion is likely limited and eye-to-hand coordination may be affected. Other people are challenged by conditions caused by severe arthritis or arm injuries which simply limit the useful range of motion of their arms.

So-called "self-leveling spoons" of various designs have been proposed to help people feed themselves without spilling food excessively. Although differing from one another in one aspect or another, the conventional self-leveling spoons share a common characteristic of having a single degree of rotational freedom which is about the longitudinal axis of the handle of the spoon. The following patent documents disclose spoons which adopt this conventional design:

U.S. Pat. No. 659,341;

U.S. Pat. No. 2,636,266;

U.S. Pat. No. 2,682,705;

U.S. Pat. No. 2,741,027;

U.S. Pat. No. 2,809,426;

U.S. Pat. No. 4,028,803;

U.S. Pat. No. 4,389,777;

U.S. Pat. No. 4,993,156;

British patent doc. no. 833,889 (May 4, 1960);

German patent doc. no. 2,005,351 (Aug. 19, 1971).

It has been proposed to fasten a self-leveling spoon to the hand of the user with straps. U.S. Pat. No. 4,325,187 shows a self-leveling spoon which discloses a strap system for fastening the handle of the spoon to the user's hand. This is illustrated in FIG. 5 as element 12. As with other conventional self leveling spoons, the bowl 18 has only a single degree of rotational freedom with respect to the handle 20, 32, which is along the longitudinal axis of the handle.

The most salient limitation of the conventional self-leveling spoons is the ability to rotate about only one axis.

These spoons will function adequately if the axis of rotation of the user's hand happens to coincide precisely with the longitudinal axis of the spoon. If the user fails to accomplish this coincidence, the spoon will spill its contents just like an ordinary spoon. For most persons with impaired or undeveloped physical capacities, this is simply too much to ask.

In the last decade, solutions of increasing sophistication have been proposed. U.S. Pat. No. 4,433,950 shows a motorized self-feeding apparatus which has a spoon B which is moved about by a complex mechanical linkage system (see FIGS. 1 & 3). U.S. Pat. No. 5,037,261 shows a motorized self-feeding apparatus which has a spoon 20 which is moved about by a complex mechanical linkage system. FIGS. 2 & 3 are most illustrative. U.S. Pat. No. 5,282,711 shows a robotic self-feeding apparatus which has a spoon 64 which is moved about by a complex mechanical linkage. The system is computer controlled. The devices proposed by these disclosures are of such a high level of complexity and sophistication that they would almost certainly cost at least two orders-of-magnitude more to manufacture than ordinary spoons.

Forks have been disclosed which have tine portions which rotate with respect to their handles. However, it does not appear that these would be particularly helpful to persons with impaired motor skills. These inventions are directed toward solving the particular problem of eating spaghetti. U.S. Pat. No. 2,602,996 shows a fork which a prong and shank section 14 which rotates with respect to the handle 13. Rotation is along the longitudinal axis of the handle and is controlled by the user at thumb wheel 15. U.S. Pat. No. 4,599,797 shows a fork which a prong and shank section 14 which rotates with respect to the handle 12. Rotation is along the longitudinal axis of the handle and is controlled by the user at thumb wheel 18.

A dipping device has been proposed which provides for rotation of a bowl with respect to the handle about more than one axis. U.S. Pat. No. 1,545,365 shows a skimmer ladle which has a bowl 4 which rotates with respect to the handle 5. It has two degrees of rotational freedom which are about the orthogonal axes which are transverse to the longitudinal axis of the handle of the ladle. Rotation of the bowl 4 is performed by the user manipulating controls 20, 15, 10, 12. The skimmer ladle has no self-leveling structure to prevent spilling.

A problem common to the conventional self-leveling spoons is the trapping of food particles inside the moving parts. Cleaning of the conventional spoons is difficult when food or dirt gets into the moving parts.

SUMMARY OF THE INVENTION

It is an objective of the present invention to provide a device which helps persons who have underdeveloped, reduced, or impaired motor skills to more readily feed themselves.

It is also an objective of the present invention to provide a cutlery item which has a working end which remains in a fixed angular orientation with respect to the earth, regardless of the orientation of the hand holding the item.

It is also an objective of the present invention to provide a spoon, fork, or knife which has a self-leveling functionality and which allows rotational movement of the working end with respect to the handle about two orthogonal axes.

It is also an objective of this invention to provide a self-leveling cutlery device which allows rotational movement of the working end with respect to the handle about two orthogonal axes, and which may be selectively adjusted about a third axis which is transverse to the other axes.

It is also an objective of the present invention to provide a self-leveling cutlery device which allows rotational movement of the working end with respect to the handle about two orthogonal axes, and which may be selectively locked so as to inhibit all such rotational movement.

It is also an objective of the present invention to provide a self-leveling cutlery device which is comprised of component parts which may be easily formed and manufactured.

It is also an objective of the present invention to provide a self-leveling cutlery device which may be easily cleaned and partially disassembled for cleaning.

The invention provides an eating utensil which is to be gripped by (or perhaps strapped to) a hand of a user. The eating utensil according to the present invention provides the user with a food holding platform which will remain in a relatively stable angular orientation while the user is moving the food between the table and their mouth. This stability is maintained regardless of the angular orientation of the hand gripping the spoon. In other words, the only rotational motion which is transferred to the food holding platform from the handle is that about the vertical axis. Thus, the platform is always level. All elements of translational motion of the hand are transferred to the food holding platform.

This leveling functionality is accomplished by two sets of structures working in conjunction with one another. First, the isolation of rotational motion from translational motion results because an isolating means allows two degrees of rotational freedom between the surface gripped by the hand and the food holding platform. Second, the angular stability of the food holding platform is due to a stabilizing means which has a counter weight which is linked to the platform.

Since two of the rotational elements of the motion of the gripping hand are rendered irrelevant by this invention, the task of moving the utensil from the plate to the mouth without spilling the food is greatly simplified. Using this invention, the user need only concentrate on performing the proper translational elements of the feeding motion without worrying about coordinating the rotational elements of the motion as well. In contrast with conventional self leveling spoons, which provide simply a single degree of rotation of the bowl with respect to the handle, the task of self feeding is substantially simplified.

In addition, the counter weight (through its linkage to the bowl of the spoon) has a stabilizing effect which isolates the bowl from shaking or oscillating motions of the user's hand. Such shaking (or oscillations, or tremors) may arise due to various pathologies, for example, Parkinson's disease. The stabilizing effect provided by the invention makes it possible for persons with tremors to feed themselves without shaking the better part of the food from the utensil.

Thus, the total effect of certain features of the invention is to provide a utensil which is non-spilling.

Another element of the invention is a selective locking structure which acts to inhibit the self-leveling action of the utensil for the temporary purpose of making it easier to scoop, stab, or otherwise capture food on the utensil. When the utensil is brought into an attitude for scooping at the table, the locking structure engages each of the cooperating isolating means and stabilizing means so that the whole utensil is temporarily frozen so as to act like an ordinary single piece eating utensil. When the utensil is raised from the plate, the isolating means and stabilizing means are freed to function and the utensil resumes its self-leveling functions.

This invention may be used by handicapped persons and small children to enable them to feed themselves. Restaurants may keep a stock of these utensils for use at their customers' request as a reasonable accommodation to conform with The Americans With Disabilities Act.

DETAILED DESCRIPTION OF THE PREFERRED EMBODIMENTS

The present invention may be embodied as a spoon, or as a fork, or as a knife, or any utensil or tool that would beneficially be modified to be self-leveling. However, for the sake of clarity of the disclosure, the illustrative description is consistently phrased for the spoon embodiment only. The spoon working end referred to in the following description may be advantageously supplanted by the working end of any handheld implement.

The handle of the utensil may be caused to rotate about any of the pitch, roll, and yaw axes in any combination by the simple input of motion from the hand holding the handle. However, the working end of the utensil does not follow all the elements of the handle's rotation. The working end does not pitch. It does not roll. This means it always stays level. The only other element of rotational motion, yaw, does transfer from the handle to the working end.

Figure 1A:
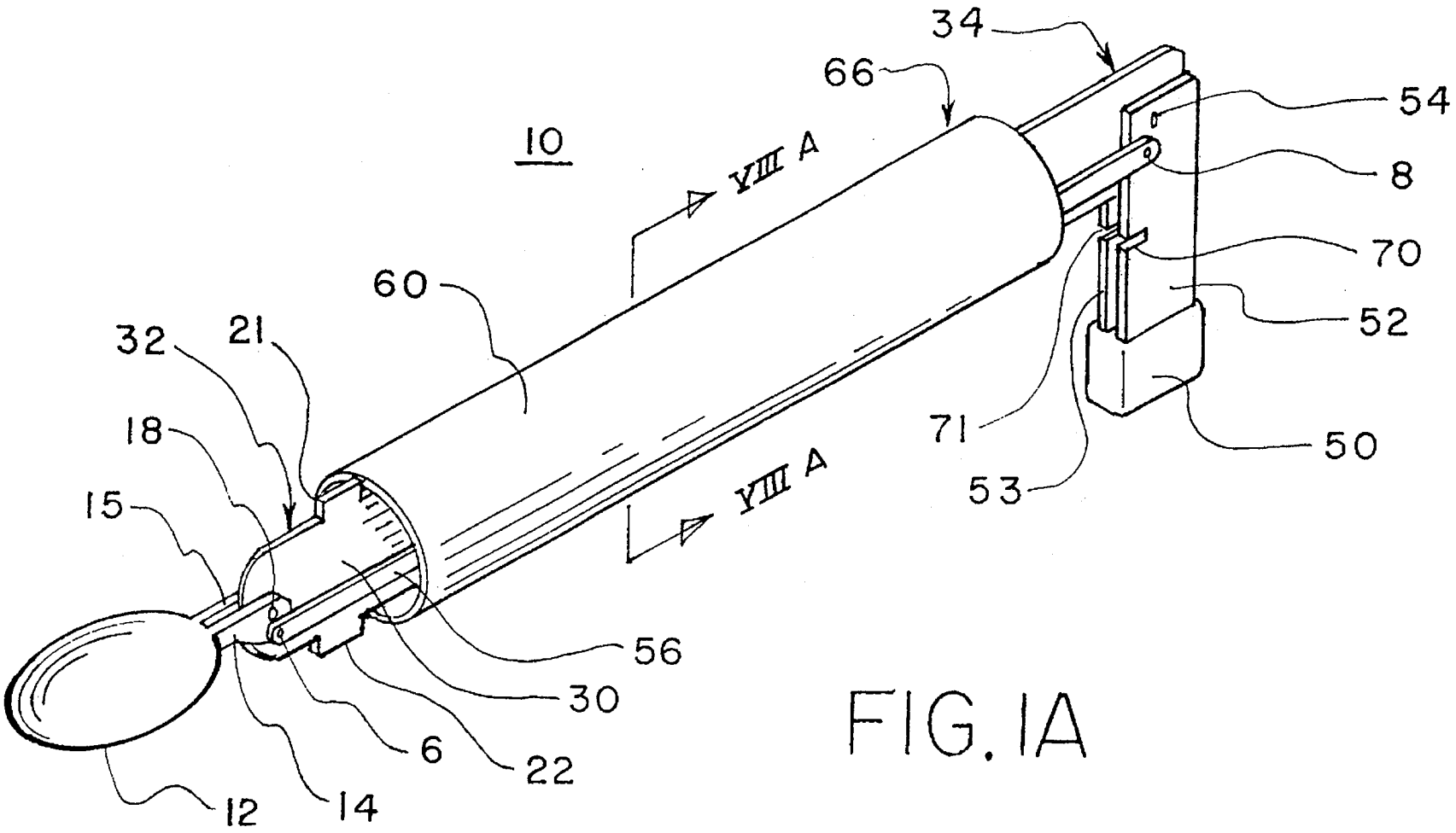
FIG. 1A shows a perspective view of the invention according to a first embodiment.

The perspective view of FIG. 1A illustrates a first embodiment of the invention. The spoon 10 has a bowl 12 for scooping and holding food. The bowl 12 is connected by shank 14 and shank 15 which rotate about the front shaft 18. The shaft 18 is mounted in the front shaft recess 20 which is disposed at the proximal end 32 of the elongate main body 30 of the spoon 10. At the distal end 34 of the main body 30, the rear shaft 54 is mounted in the rear shaft recess 40 which is disposed at the distal end 34 of the elongate main body 30 of the spoon 10.

At the distal end of the spoon 10, a counter weight 50 is mounted to the rear shanks 52 and 53. The rear shanks 52 and 53 rotate about the rear shaft 54. The front shanks 14 and 15 and the rear shanks 52 and 53 are mechanically linked to one another by pushrod 56, which is disposed so as to move freely along the entire length of the main body 30. The pushrod 56 is connected to front push rod shaft 6 on front shank 14 and rear push rod shaft 8 on rear shank 52. The pushrod 56 is retained onto shafts 6 and 8 by a fastener. The fastener used may be a flared snap-on shaft end, a rivet, a locknut, or any other appropriate fastening means as would be appreciated by an artisan of ordinary skill. Alternatively, the mechanical pushrod 56 is retained on the shafts 6 and 8 by flaring the ends of the shafts through plastic deformation.

This mechanical linkage structure results in the bowl 12 and the counter weight 50 being linked together in a fixed angular relationship to one another. Counter weight 50 is connected at the bottoms of rear shanks 52 and 53 to maintain the rear shanks in an upright orientation. This structural linking of the bowl 12 to the counter weight 50 provides the stabilizing functionality of the invention.

Surrounding a substantial portion of the main body 30 is a handle 60 which is to be gripped by the hand of the user. As an option, the handle 60 may be provided with a strap 419 (as partially shown in FIG. 4 at the fastening point at the distal end of the handle 60). The strap 419 may be elastic or inelastic and may be adjustable. The handle 60 rotates about the main body 30 with no restriction on its range of motion. The handle 60 is free to slide back and forth longitudinally along the main body 30 only a short distance. The handle 60 is inhibited from excess longitudinal movement towards the proximal end 32 by tabs 21 and 22, which are formed as integral extensions from the main body 30. The handle 60 is inhibited from excess longitudinal movement towards the distal end by the contact of the handle 60 distal end contacting rear shanks 52 and 53. The rotation of the handle 60 about the body 30 in conjunction with the rotation of the front shanks 14 and 15 provides the isolation functionality of the invention.

Figure 4:
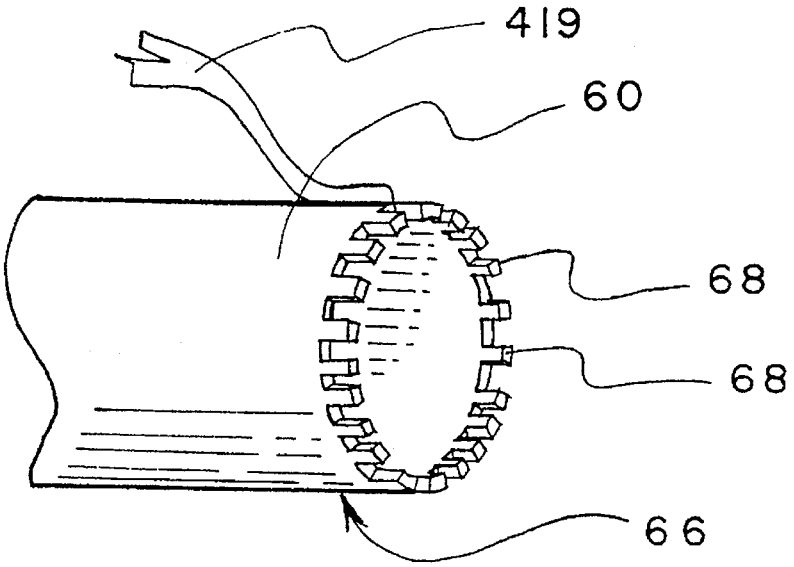
FIG. 4 shows a detail view of the distal end of the handle.

As shown in FIG. 4, the distal end 66 of the handle 60 has a row of rearwardly projecting, longitudinally extending projections 68 which act as one portion of the motion inhibiting means of the invention. Another portion of the motion inhibiting means is the pair of catches 70 and 71 mounted on the rear shanks 52 and 53, respectively. The projections 68 and the catches 70 and 71 function so as to interlock with one another when the spoon 10 is tilted with the bowl 12 in a lowered position so as to scoop up food. When the spoon 10 is tilted downward, gravity acts to pull the body 30 of the spoon down and forward through the handle 60, thus causing the handle 60 to move closer to the rear shanks 52 and 53. When the handle 60 contacts the rear shanks 52 and 53, the projections 68 engage the catches 70 and/or 71.

The main body 30 is advantageously formed as a flat piece, and the handle 60 as a hollow cylinder having a circular cross section.

The spoon 10 may be disassembled for cleaning by simply pulling the rear shanks 52, 53 back so as to be in alignment with the main body and pulling the handle 60 right over the counter weight 50 and off of the main body. The spoon 10 is easily reassembled by reversing the process.

Figure 1B:
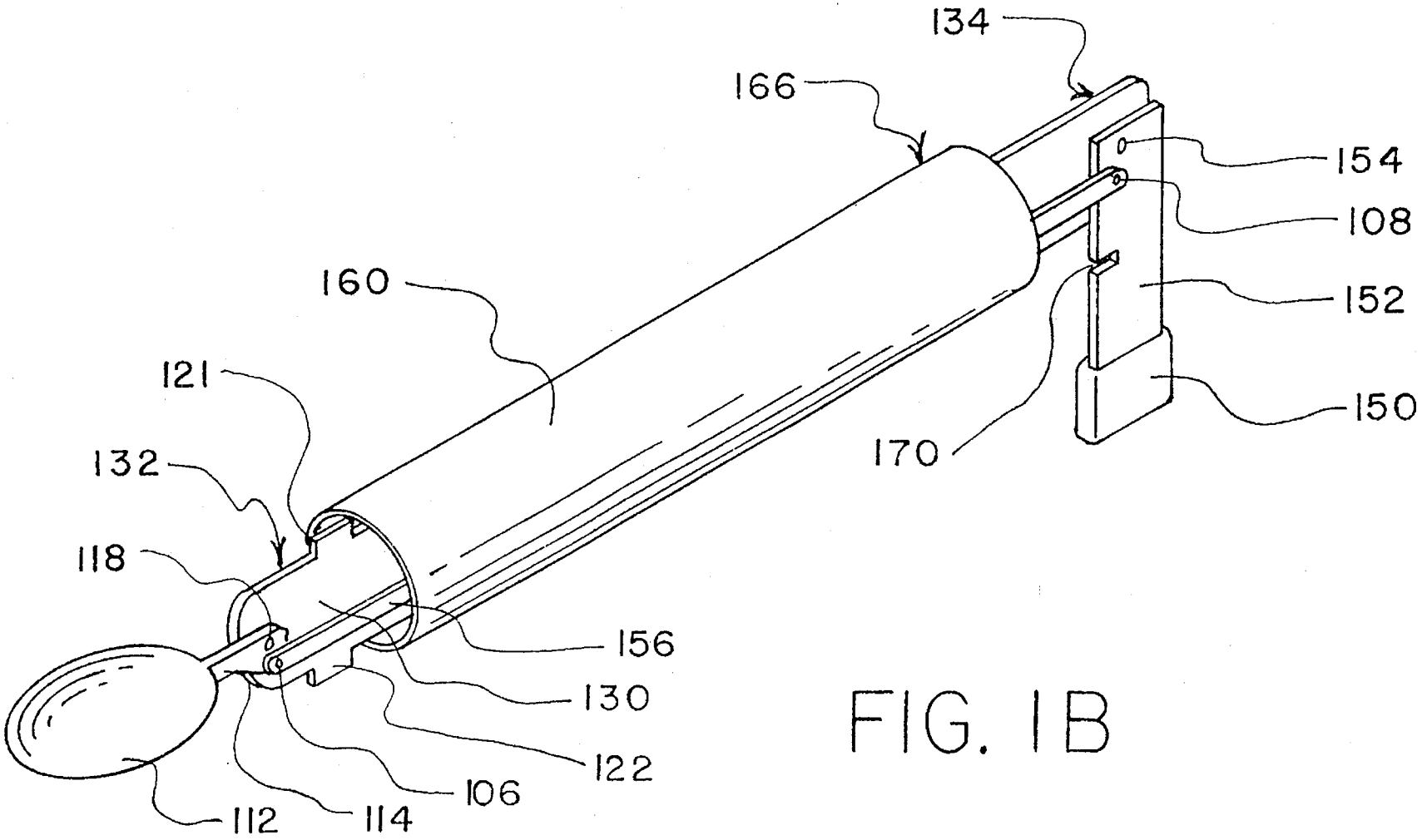
FIG. 1B shows a perspective view of the invention according to a second embodiment.

FIG. 1B shows a perspective view of the invention according to a second embodiment. The spoon 110 has a bowl 112 for scooping and holding food. The bowl 112 is connected by shank 114 which rotates about the front shaft 118. The shaft 118 is mounted to the proximal end 132 of the elongate main body 130. The rear shaft 154 is mounted at the distal end 134 of the elongate main body 130.

At the distal end of the spoon 110, a counter weight 150 is mounted to the rear shank 152. The rear shank 152 rotate about the rear shaft 154. The front shank 114 and the rear shank 152 are mechanically linked to one another by pushrod 156, which is disposed so as to move freely along the entire length of the main body 130. The pushrod 156 is connected to front push rod shaft 106 on front shank 114 and rear push rod shaft 108 on rear shank 152. The pushrod 156 is retained onto shafts 106 and 108 by a fastener. The fastener used may be a flared snap-on shaft end, a rivet, a locknut, or any other appropriate fastening means as would be appreciated by an artisan of ordinary skill. Alternatively, the mechanical pushrod 156 is retained on the shafts 106 and 108 by flaring the ends of the shafts through plastic deformation.

The second embodiment of the invention, shown in FIG. 1B, is identical in structure and function to the first embodiment shown in FIG. 1A, except that only one front shank 114 and one rear shank 152 are utilized and are attached to main body 130 by a shaft 118 and a shaft 154, respectively. The shafts 118 and 154 are fixedly fastened to, or integrally formed, with the main body 130. The shanks 114 and 152 are rotatably attached to their respective shafts by a fastener. The fastener used may be a flared snap-on shaft end, a locknut, or any other appropriate fastening means as would be appreciated by an artisan of ordinary skill. Alternatively, the shanks 114, 152 are retained on the shafts 118, 154 by flaring the ends of the shafts 118, 154 through plastic deformation.

As an alternative configuration, the shafts 118, 154 may be configured so that they are fixedly attached to the shanks 114, 152 and rotatably attached to the main body 130.

Figure 2:
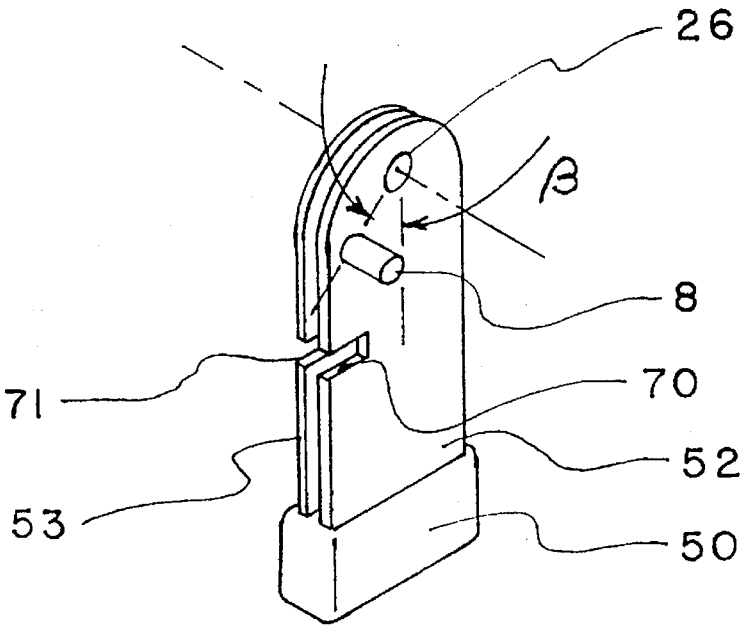
FIG. 2 shows a perspective detail view of the rear shank and counter weight portion of the invention according to the first embodiment of FIG. 1A.

FIG. 2 shows a perspective detail view of the rear shank and counter weight assembly portion of the invention according to the first embodiment. Rear pushrod shaft 8 is shown as being fixedly fastened to rear shank 52. Counterweight 50 is attached to each of the rear shanks 52, 53 having locking recesses 70, 71. The inventor has discovered that an advantageous geometry for operation of the self-leveling spoon may be achieved by carefully selecting the position of the rear pushrod shaft 8 with respect to the rear shaft recess 26. The angle formed between the longitudinal axis of the rear shank 52 and the line between the rear shaft rotation axis (disposed through shaft recess 26) and the rear pushrod shaft 8 is designated as $\beta$ in FIG. 2. The angle $\beta$ is advantageously chosen from within the range of from 35 to 55 degrees. The spoon 10 functions optimally when the angle $\beta$ is chosen to be 45 degrees.

Figure 3:
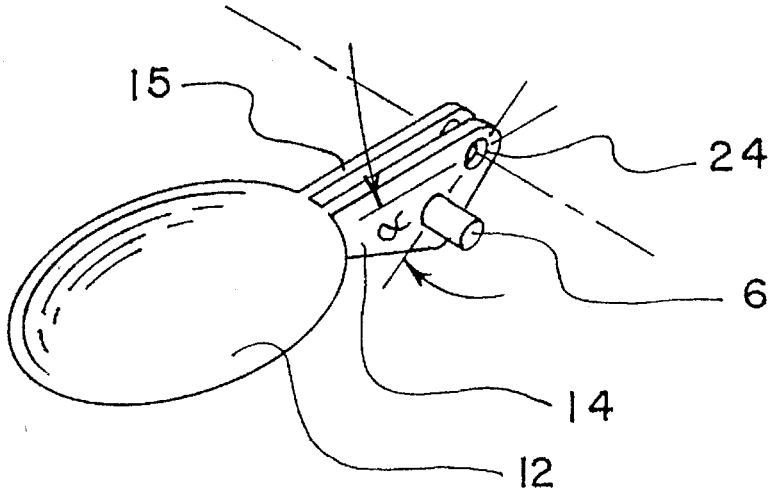
FIG. 3 shows a perspective detail view of the front shank and bowl portion of the invention according to the first embodiment of FIG. 1A.

FIG. 3 shows a perspective detail view of the bowl assembly portion of the invention according to the first embodiment. Bowl 12 is supported by front shanks 14, 15. Front pushrod shaft 6 is shown as being fixedly fastened to front shank 14. The inventor has discovered that an advantageous geometry for operation of the self-leveling spoon may be achieved by carefully selecting the position of the front pushrod shaft 6 with respect to the front shaft recess 24. The angle formed between the longitudinal axis of the front shank 14 and the line between the front shaft rotation axis (disposed through shaft recess 24) and the front pushrod shaft 6 is designated as $\alpha$ in FIG. 3. The angle $\alpha$ is advantageously chosen from within the range of from 35 to 55 degrees. The spoon 10 functions optimally when the angle $\alpha$ is chosen to be 45 degrees.

Figure 5:
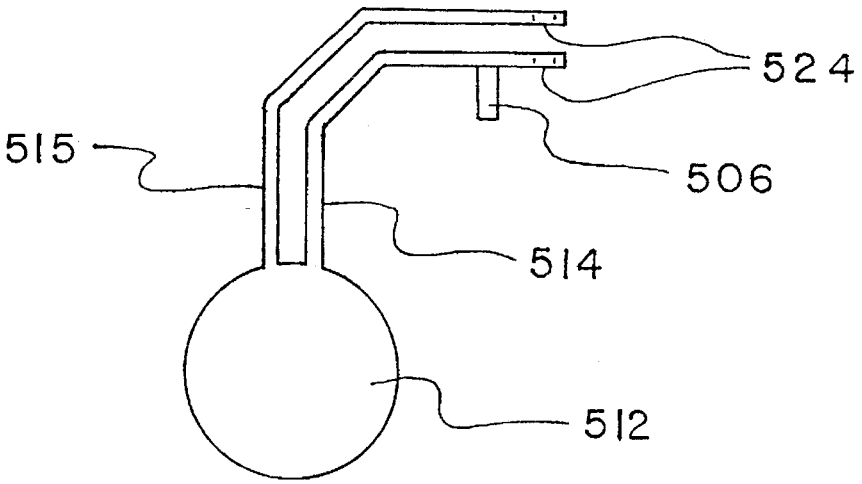
FIG. 5 shows a detail top view of the front shank and bowl portion of the invention according to a third embodiment.

FIG. 5 shows a top detail view of the bowl assembly portion of the invention according to a third embodiment of the invention. The bowl 512 is supported by shank 514 and shank 515. The shanks 514, 515 are formed so that the bowl 512 is aligned at an angle of about ninety degrees with respect to the longitudinal axis of the spoon. This is an advantageous configuration particularly for persons who have very limited range of motion in their wrists.

Figure 6:
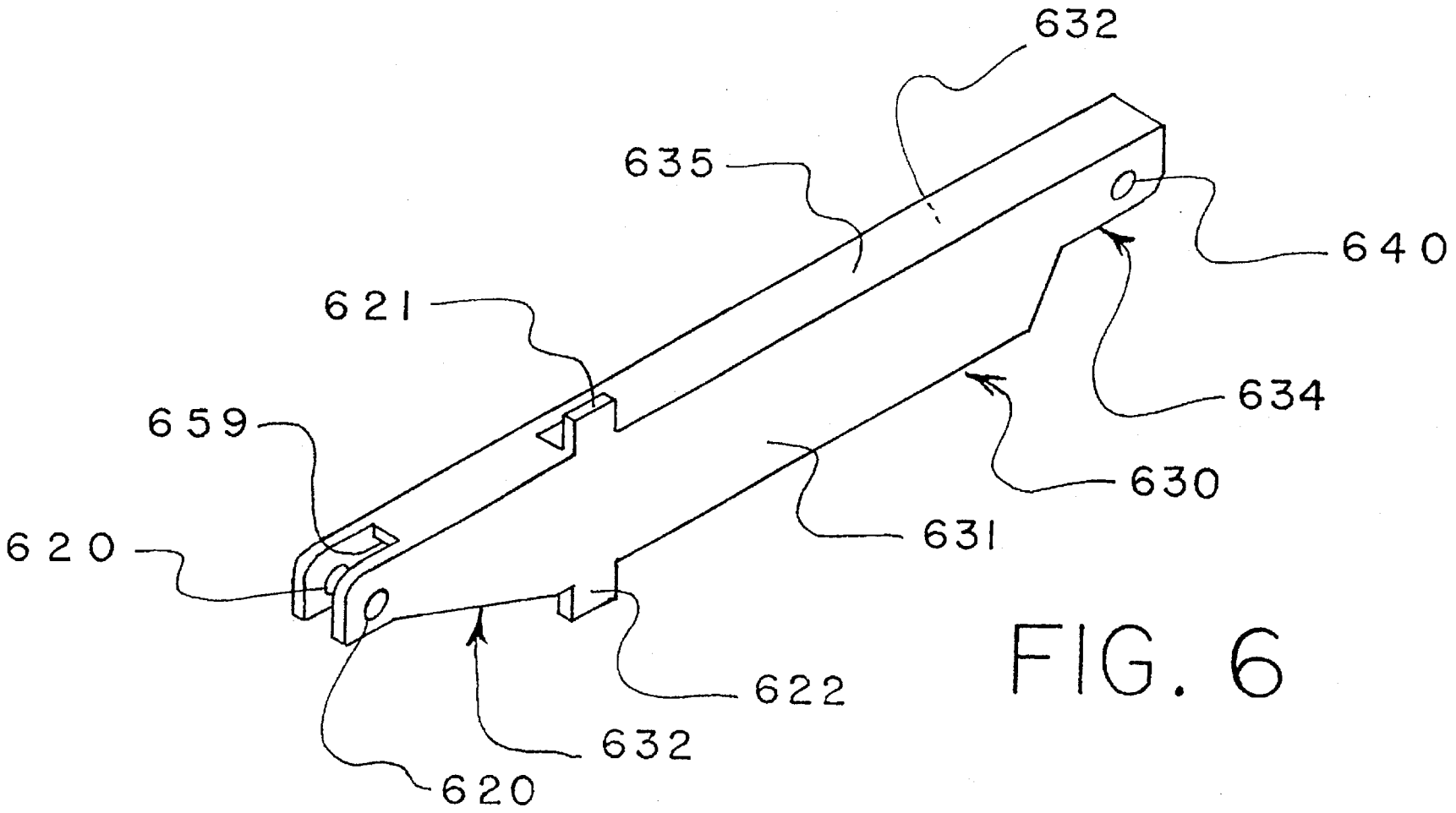
FIG. 6 shows a perspective detail view of the main body of the eating utensil according to a fourth embodiment.

FIG. 6 shows a perspective detail view of a main body 630 according to a fourth embodiment of the invention. The main body 630 is formed as having two opposed halves 631 and 633 coupled together by an intermediate member 635. Together opposed halves 631, 633 and intermediate member 635 form a channel 659 through which a pushrod (shown in FIG. 8B as pushrod 656) is passed. According to the fourth embodiment, the structures according to the first embodiment are modified to accommodate a pushrod being disposed within the channel 659. The pushrod is attached to a rear pushrod shaft (not shown) which is provided between the rear shanks 52 and 53. At the front of the spoon, the pushrod is mounted to the front shanks 14 and 15 on a front pushrod shaft (not shown) which is provided between shanks 14 and 15.

The fourth embodiment may also be realized by a two piece main body which does not have an intermediate member 635 holding opposed halves 631 and 633 together.

Figure 7:
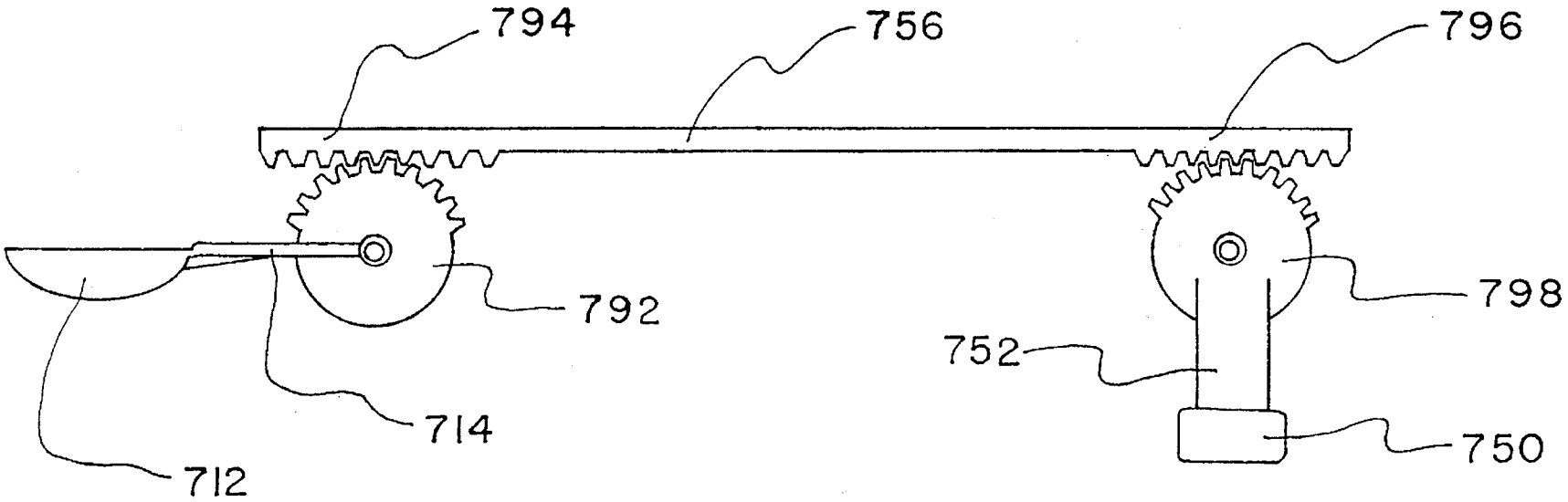
FIG. 7 shows a detail view of the mechanical linkage according to a fifth embodiment.

FIG. 7 shows a side view of a mechanical linkage according to a fifth embodiment of the invention. The mechanical linkage between the bowl 712 and the counter weight 750 is formed as a pushrod 756 having a front rack 794 which engages front geared pinion 792, and a rear rack 796 which engages rear geared pinion 798. The bowl 712 is supported by shank 714 coupling it to front geared pinion 792. The counter weight 750 is supported by shank 752 coupling it to rear geared pinion 798.

Figure 8B:
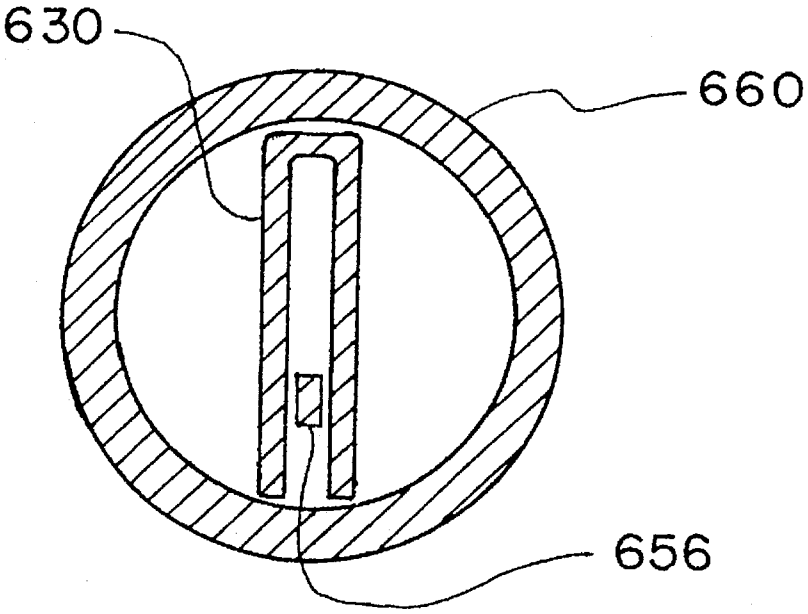
FIG. 8B shows a sectional view of the invention according to the fourth embodiment.
Figure 8A:
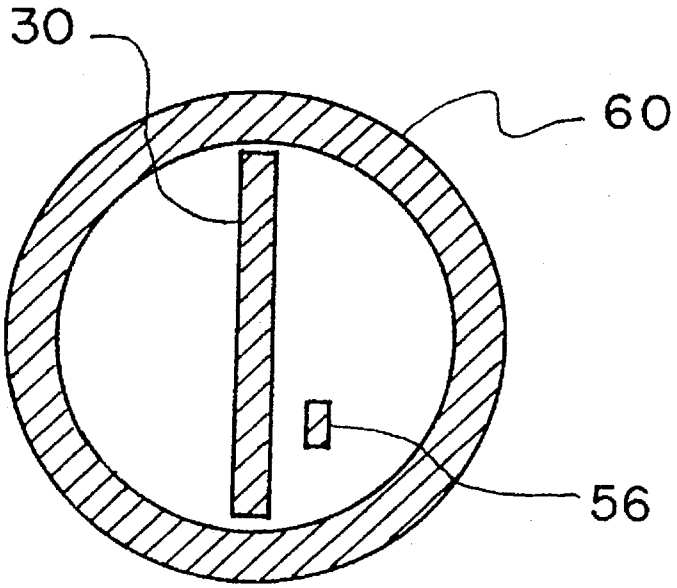
FIG. 8A shows a sectional view of the invention according to the first embodiment shown in FIG. 1A.

FIG. 8A shows a cross section view of a spoon according to the first embodiment of the invention as shown in FIG. 1A. The main body 30 is disposed inside the handle 60. The pushrod 56 is disposed along main body 30 and inside the handle 60.

The mechanical linkage from the front shanks 14 and 15 to the rear shanks 52 and 53 may be formed as a single pushrod 56 or as a pair of pushrods on either side of the main body.

FIG. 8B shows a cross section view of a spoon according to the fourth embodiment of the invention, wherein the main body 630 is formed as a channel through which pushrod 656 passes. The body 630 is disposed inside the handle 660.

Figure 9:
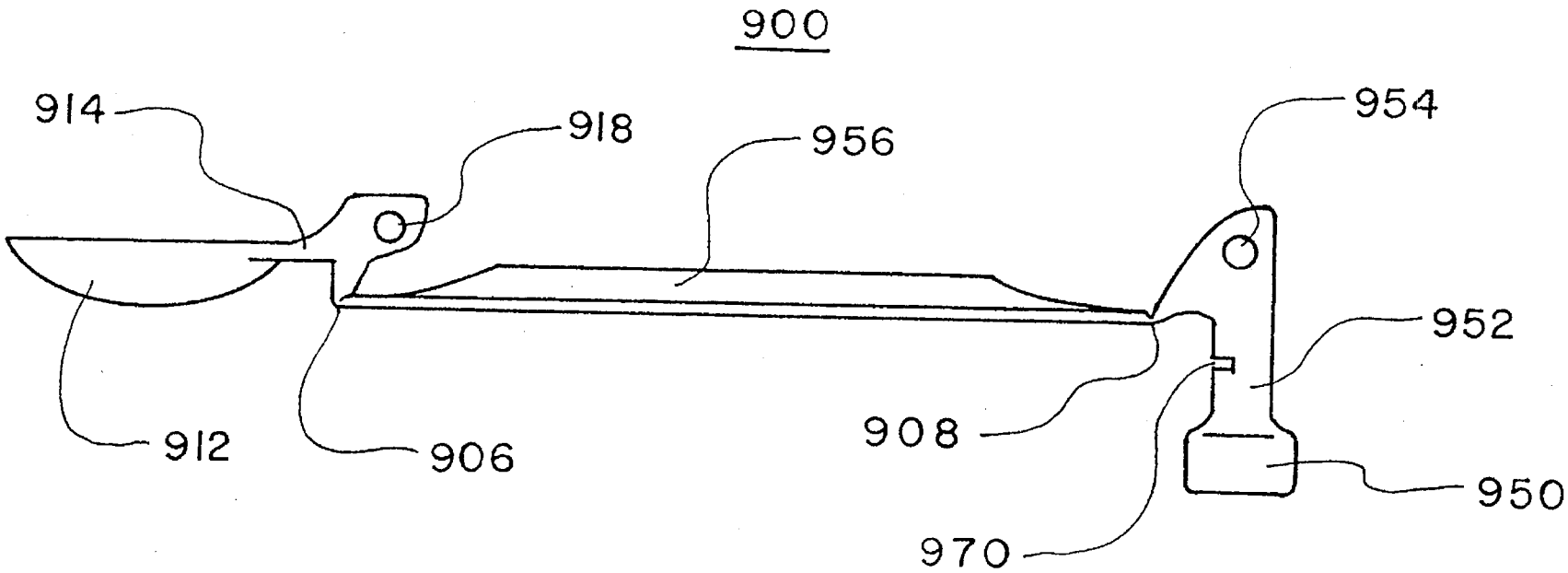
FIG. 9 shows a view of the front bowl portion, mechanical linkage and rear portion according to a sixth embodiment of the invention.

FIG. 9 illustrates a sixth embodiment of the invention. In this embodiment, the front portion including the bowl 912, the rear portion including the counter weight 950, and the mechanical pushrod 956 are formed together as a unitary whole called a bowl/counter weight assembly 900. The bowl/counter weight assembly 900 may advantageously be combined with the channel shaped main body 630 according to FIG. 6. 0f course, the assembly 900 may also be embodied such that it may be combined with a main body as described according to the other embodiments of the invention by choosing whether to form front shaft 918 and rear shaft 954 on one or both sides of the assembly.

The bowl/counter weight assembly 900 has a bowl 912 for scooping and holding food. The bowl 912 is connected by shank 914 which rotates about the front shaft 918. The shaft 918 is formed as a unitary part of shank 914 on both sides (the opposite side is not shown). This front shaft 918 rotatably engages the shaft recesses 620 at the proximal end 632 of the elongate main body 630 of the spoon. At the distal end 634 of the main body 630, the rear shaft 954 is mounted in the rear shaft recesses 640 which are disposed at the distal end 634 of the elongate main body 630 of the spoon.

At the distal end of the bowl/counter weight assembly 900, a counter weight 950 is mounted to the rear shank 952. The rear shank 952 rotates about the rear shaft 954. The front shank 914 and the rear shank 952 are mechanically linked to one another by pushrod 956, which is disposed so as to move freely along the inside of the channel of the main body 630. The pushrod 956 is connected to the front shank 914 by the front push rod flexible webbing 906 and to the rear shank 952 by the rear push rod flexible webbing 908. The flexible webbings 906, 908 function as hinges. To realize the necessary flexibility for functioning of the flexible webbings 906,908, the unitary assembly 900 according to the sixth embodiment is advantageously formed from a thermoplastic.

As with the other embodiments, the mechanical linkage structure formed by the assembly 900 results in the bowl 912 and the counter weight 950 being linked together in a fixed angular relationship to one another. Counter weight 950 is connected at the bottoms of rear shank 952 to maintain the rear shank 952 in an upright orientation.

Figure 10:
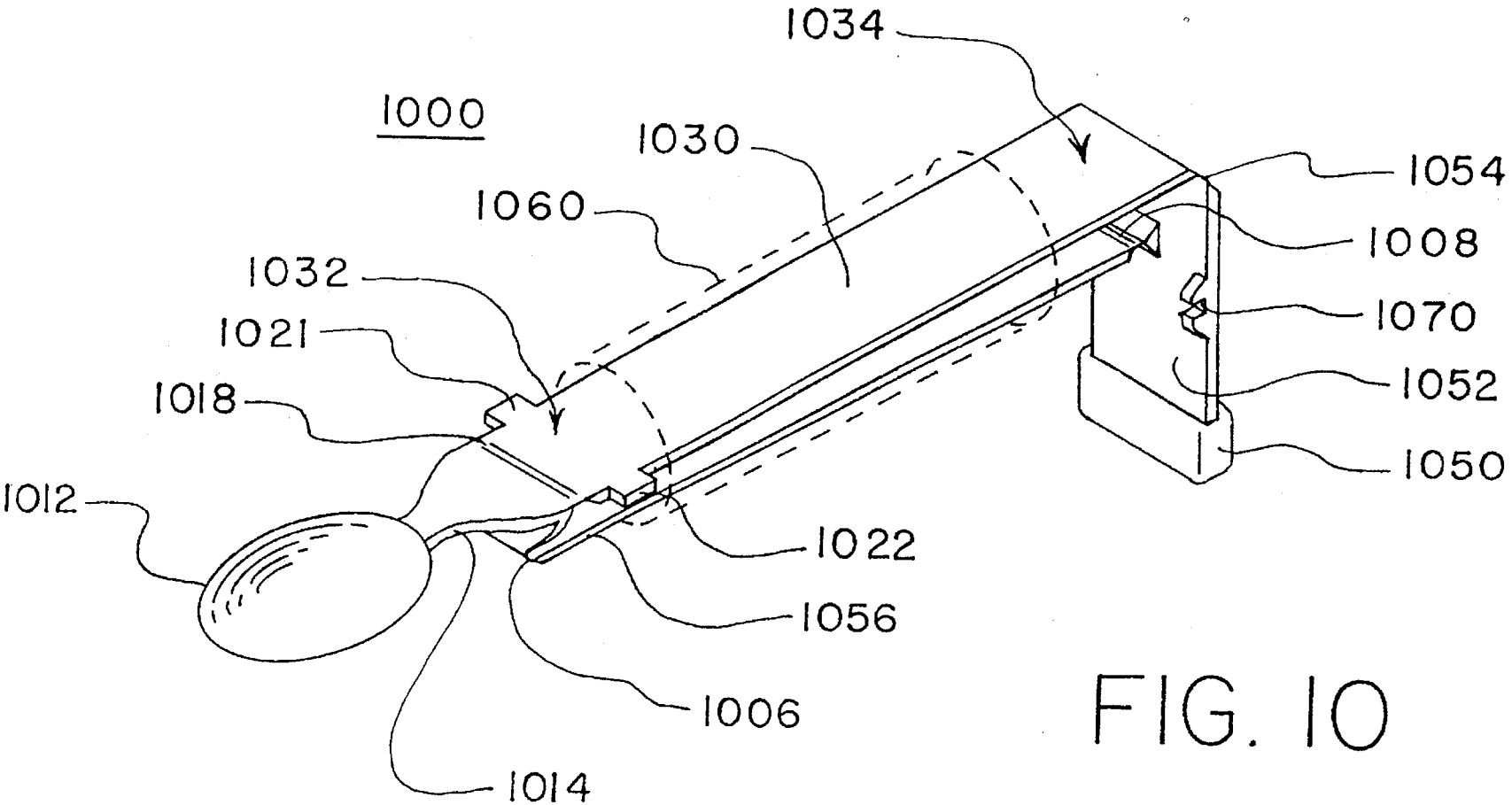
FIG. 10 shows a perspective view of the front bowl portion, rear portion, mechanical linkage and main body according to a seventh embodiment of the invention.

FIG. 10 shows a seventh embodiment of the invention. In this embodiment, the front portion including the bowl 1012, the rear portion including the counter weight 1050, the main body 1030, and the mechanical pushrod 1056 are formed together as a unitary whole called a bowl/body/counter weight assembly 1000.

The bowl/body/counter weight assembly 1000 has a bowl 1012 for scooping and holding food. The bowl 1012 is connected by shank 1014 which rotates about the front hinge 1018. The front hinge 1018 is unitarily formed as a flexible webbing between shank 1014 and the main body 1030. At the distal end 1034 of the main body 1030, the rear hinge 1054 is unitarily formed as a flexible webbing between shank 1052 and the main body 1030.

At the distal end of the bowl/body/counter weight assembly 1000, a counter weight 1050 is mounted to the rear shank 1052. The rear shank 1052 rotates about the rear hinge 1054. The front shank 1014 and the rear shank 1052 are mechanically linked to one another by pushrod 1056, which is disposed so as to move freely alongside, and in parallel with, the main body 1030. The pushrod 1056 is connected to the front shank 1014 by the front push rod hinge 1006 and to the rear shank 1052 by the rear push rod hinge 1008. The pushrod hinges 1006, 1008 are each unitarily formed as flexible webbings between the pushrod 1056 and the shanks 1014, 1052.

To realize the necessary flexibility for functioning of the hinges 1006, 1008, 1018, 1054, the unitary assembly 1000 according to the seventh embodiment is advantageously formed from a thermoplastic.

As with the other embodiments, the mechanical linkage structure formed by the assembly 1000 results in the bowl 1012 and the counter weight 1050 being linked together in a fixed angular relationship to one another. Counter weight 1050 is connected at the bottom of rear shank 1052 to maintain the rear shank 1052 in an upright orientation. In distinction from the other embodiments, the main body 1030 is oriented so that it is transverse to a vertical plane rather than lying in the vertical plane.

In FIG. 10, the handle 1060 is shown in phantom surrounding the main body 1030 portion of the assembly 1000. The forward travel (i.e., toward the proximal end 1032 of the main body 1030) of the handle 1060 along the main body 1030 is impeded by tabs 1021 and 1022, which are formed as integral extensions from the main body 1030.

The bowl 12 of the spoon 10 may be embodied as a combination of a spoon and fork, popularly known as a "spork". According to this alternative embodiment, the proximal periphery of the bowl of the spoon is modified to have three notches in it. This results in a spoon which has small fork-like tines on its leading edge.

The utensil may be made of most any solid material which is biocompatible and which is sufficiently robust to maintain its structural integrity even when used on hot or cold foods, or when subjected to cleaning in a hot dishwasher. More specifically, the components of the utensil are to be made from metals, such as brass or stainless steel. Alternatively, the components of the utensil are to be made from plastics such as nylon, polyethylene, or polytetrafluoroethylene (Teflon (TM)).

Optionally, the exterior surface of the handle may be knurled (not shown), or otherwise roughened, to make the utensil easier to grip. The handle may also be provided with a strap (419 in FIG. 4) to fasten the utensil onto the hand of a person with marginal or inconsistent grip strength. The main body may be embodied as having a broad range of different lengths. It may be as short as a couple inches for a spoon for infants. It may be about six inches long for an adult-size spoon. And it may be as long as two feet or more; this extra-long length is intended to accommodate the needs of persons whose range-of-motion limitations prevent them from moving their hands close to their mouths.

The counter weight may be comprised of any relatively heavy material. Lead, iron, and bismuth are sufficient. However, if a toxic metal such as lead is used, it should be securely coated with plastic to render the apparatus non-toxic.

While a number of exemplary embodiments of the invention have been described using specific terms, such description is for illustrative purposes. It is to be understood that changes and variations may be made without departing from the spirit or scope of the invention. The scope of the invention is limited only so far as the following claims.

What is claimed is:

1. A self leveling eating utensil comprising:

an elongate main body having a longitudinal axis, a proximal end, and a distal end;

a handle, having a proximal end and a distal end, which substantially surrounds said main body and is movable with respect to said main body;

a working portion connected to the proximal end of said main body and free to rotate with respect to said main body;

a weighted portion connected to the distal end of said main body and free to rotate with respect to said main body; and a mechanical link member disposed parallel to the longitudinal axis of said main body, connected to said working portion and said weighted portion;

whereby said working portion is held relatively level regardless of the angular orientation of said handle.

2. The eating utensil according to claim 1 further comprising:

a plurality of projections disposed at the distal end of said handle; and catches attached to said weighted portion;

whereby said projections and said catches mechanically engage one another when the eating utensil is held such that said working portion is substantially lower than the rest of the eating utensil.

3. The eating utensil according to claim 1, wherein said main body is formed as a flat plate.

4. The eating utensil according to claim 1, wherein said main body is formed as a pair of opposed flat plates.

5. The eating utensil according to claim 1, wherein said main body is formed as a pair of opposed flat plates joined by an intermediate member to form a channel.

6. The eating utensil according to claim 5, wherein said link member is disposed inside said channel.

7. The eating utensil according to claim 1, wherein said working portion comprises:

a spoon bowl supported by a pair of front shanks;

wherein said front shanks are rotatably connected to said main body by a front shaft and one of said front shanks is rotatably connected by a front pushrod shaft to said link member, an angle $\alpha$ formed between a line extending from said bowl to said front shaft and a line extending from said front pushrod shaft to said front shaft is within the range of 35 to 55 degrees.

8. The eating utensil according to claim 7, wherein said angle $\beta$ is about 45 degrees.

9. The eating utensil according to claim 1, wherein said weighted portion further comprises:

a counter weight supported by a pair of rear shanks;

wherein said rear shanks are rotatably connected to said main body by a rear shaft and one of said rear shanks is rotatably connected by a rear pushrod shaft to said link member, an angle $\beta$ formed between a line extending from said counter weight to said rear shaft and a line extending from said rear pushrod shaft to said rear shaft is within the range of 35 to 55 degrees.

10. The eating utensil according to claim 9, wherein said angle $\beta$ is about 45 degrees.

11. The eating utensil according to claim 1, wherein said elongate main body, said working portion, said weighted portion and said mechanical link member are formed together as a unitary assembly.

12. The eating utensil according to claim 1, wherein said elongate main body, said working portion and said weighted portion are formed together as a unitary assembly.

13. The eating utensil according to claim 1, wherein said working portion, said weighted portion and said mechanical link member are formed together as a unitary assembly.

14. The eating utensil according to claim 11, wherein said elongate main body is connected to said working portion by a front hinge formed as a flexible webbing, said elongate main body is connected to said weighted portion by a rear hinge formed as a flexible webbing, said mechanical linkage member is connected to said working portion by a front pushrod hinge formed as a flexible webbing, and said mechanical linkage member is connected to said weighted portion by a rear pushrod hinge formed as a flexible webbing.

15. The eating utensil according to claim 12, wherein said elongate main body is connected to said working portion by a front hinge formed as a flexible webbing and said elongate main body is connected to said weighted portion by a rear hinge formed as a flexible webbing.

16. The eating utensil according to claim 13, wherein said mechanical linkage member is connected to said working portion by a front pushrod hinge formed as a flexible webbing and said mechanical linkage member is connected to said weighted portion by a rear pushrod hinge formed as a flexible webbing.

* * * * *